US005734945A

United States Patent [19]

Earle et al.

[11] Patent Number: 5,734,945

[45] Date of Patent: Mar. 31, 1998

[54] PROCESSING APPARATUS

[75] Inventors: Anthony Earle, Harrow Weald; Michael Ridgway, Herts, both of England

[73] Assignee: Eastman Kodak Company, Rochester, N.Y.

[21] Appl. No.: 550,060

[22] Filed: Oct. 30, 1995

[30] Foreign Application Priority Data

Nov. 1, 1994 [GB] United Kingdom ..... 9421940

[51] Int. Cl.[6] ..... G03D 3/02

[52] U.S. Cl. ..... 396/604; 396/627; 118/313; 118/314

[58] Field of Search ..... 354/324, 325, 354/322, 317; 118/58, 62, 63, 300, 305, 313; 134/64 P, 64 R, 122 P, 122 R; 396/604, 627, 935, 936

[56] References Cited

U.S. PATENT DOCUMENTS

| | | | |
|---|---|---|---|
| 3,630,213 | 12/1971 | Bruno et al. | 396/606 |
| 4,733,260 | 3/1988 | Kubo et al. | 354/325 X |
| 4,827,309 | 5/1989 | Kato | 118/659 |
| 5,329,331 | 7/1994 | Hatori et al. | 354/325 X |

FOREIGN PATENT DOCUMENTS

| | | | |
|---|---|---|---|
| 620495 | 10/1994 | European Pat. Off. | 354/325 |
| 1078872 | 3/1960 | Germany | 354/325 |
| 1178707 | 9/1964 | Germany | 354/325 |
| 2 102 700 | 2/1983 | United Kingdom . | |

OTHER PUBLICATIONS

The Equipment for LCD, Developing, Etching, Stripping Devices by Yoichi Fuse, Semiconductor World 1995, pp. 142–146.

*Primary Examiner*—D. Rutledge

*Attorney, Agent, or Firm*—Frank Pincelli

[57] ABSTRACT

Described herein is apparatus for applying processing solution to a photographic material using a spray bar. The spray bar can be used to meter processing solution and/or air onto the material being processed, to agitate and/or mix processing solutions on the material using air jets, to air knife the material to remove processing solutions therefrom, and to dry the material.

16 Claims, 3 Drawing Sheets

PROCESSING APPARATUS

FIELD OF THE INVENTION

The present invention relates to processing apparatus and is more particularly, although not exclusively, concerned with the use of spray bars for applying processing solutions to photographic products, and the removal of processing solutions therefrom. Moreover, the present invention is also useful for the drying of photographic products.

BACKGROUND OF THE INVENTION

It is known to use a spray bar for applying processing solutions to a photographic material, the spray bar applying the processing solution in one area of the material so that it runs down over the rest of the material.

PROBLEM TO BE SOLVED BY THE INVENTION

However, this method often leaves insufficient processing solution on the photographic material to complete the desired processing, and can produce uneven results.

SUMMARY OF THE INVENTION

It is therefore an object of the present invention to provide an improved method for applying processing solutions to photographic materials using spray bars. This may be achieved by dispensing a sessile drop or a trapped bead from a spray bar to provide a sufficient amount of processing solution on the surface of the material for an adequate time so that the process is completed.

In further objects of the present invention, spray bars of this type, when connected to an air supply, can also be used to agitate processing solutions on the surface of the material, to remove the solutions from the material, and then to speed the drying of the material.

In accordance with one aspect of the present invention, there is provided processing apparatus for processing photographic material, the apparatus including:

a support surface for supporting the photographic material during processing thereof; and applicator means for applying processing fluid to the material supported by the support surface;

characterized in that the applicator means comprises at least one bar having a plurality of uni-jets equally spaced along its length, the bar being adjusted so that each uni-jet is directed to impinge on the surface of the material to effect processing of the material.

The term "uni-jet" is intended to mean a single stream of fluid which does not coalesce with another stream from an adjacent jet.

In one embodiment, the bars may be used to apply processing solution to the surface of a photographic sheet in conjunction with means for holding the sheet flat and horizontal on a platen. The platen can have a suction arrangement for holding the sheet flat against its surface. Alternatively, the sheet can be held flat using electrostatic attraction or simply by surface tension. The platen can also be heated. Processing solutions are applied to the photographic sheet by the relative movement between each bar and the platen on which the sheet is supported.

Alternatively, the sheet can be mounted on the surface of a rotating drum. A bead of processing solution is established on the surface of the sheet by spraying solution on to the surface thereof and allowing it to run down to an air knife, formed by a bar connected to an air supply, which prevents the solution running further down the surface of the drum. Processing of the sheet is effected by the relative movement of the rotating drum, and the sheet is supports, in respect of the established bead.

The bars comprise thin-walled tubes made of stainless steel or other suitable materials which are chemically inert to photographic processing solutions. The tubes have a series of very fine holes drilled along their length, each of the very fine holes providing a uni-jet of fluid therethrough. The holes are formed in the tubes using a laser or other suitable means.

In accordance with a second aspect of the present invention, there is provided a method of processing photographic material comprising the steps of:

a) supporting the material on a support surface;

b) applying at least one processing solution to the supported material using at least one first bar having a plurality of uni-jets formed therein;

c) removing the processing solution from the supported surface using a second bar connected to an air supply, the second bar acting as an air knife; and d) drying the material using the second bar.

If the photographic material is supported on a substantially flat platen, step b) is achieved by relative movement between each first bar and the supported material, each first bar applying a predetermined processing solution to the supported material.

When at least two processing solutions are applied to the surface of the supported material, the processing solutions can be mixed thereon using the second bar.

If the photographic material is supported on a rotating cylindrical surface, step b) is achieved by establishing a bead of processing solution on the surface of the material using a third bar connected to an air supply.

ADVANTAGEOUS EFFECT OF THE INVENTION

Advantageously, the bars in accordance with the present invention may be utilized for any of the following applications either together or individually:

a) metering processing solution and/or air on to the surface of the material being processed;

b) agitating and/or mixing processing solutions on the surface of the material using air jets;

c) air knifing the surface of the material to remove processing solutions therefrom; and d) drying the material.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
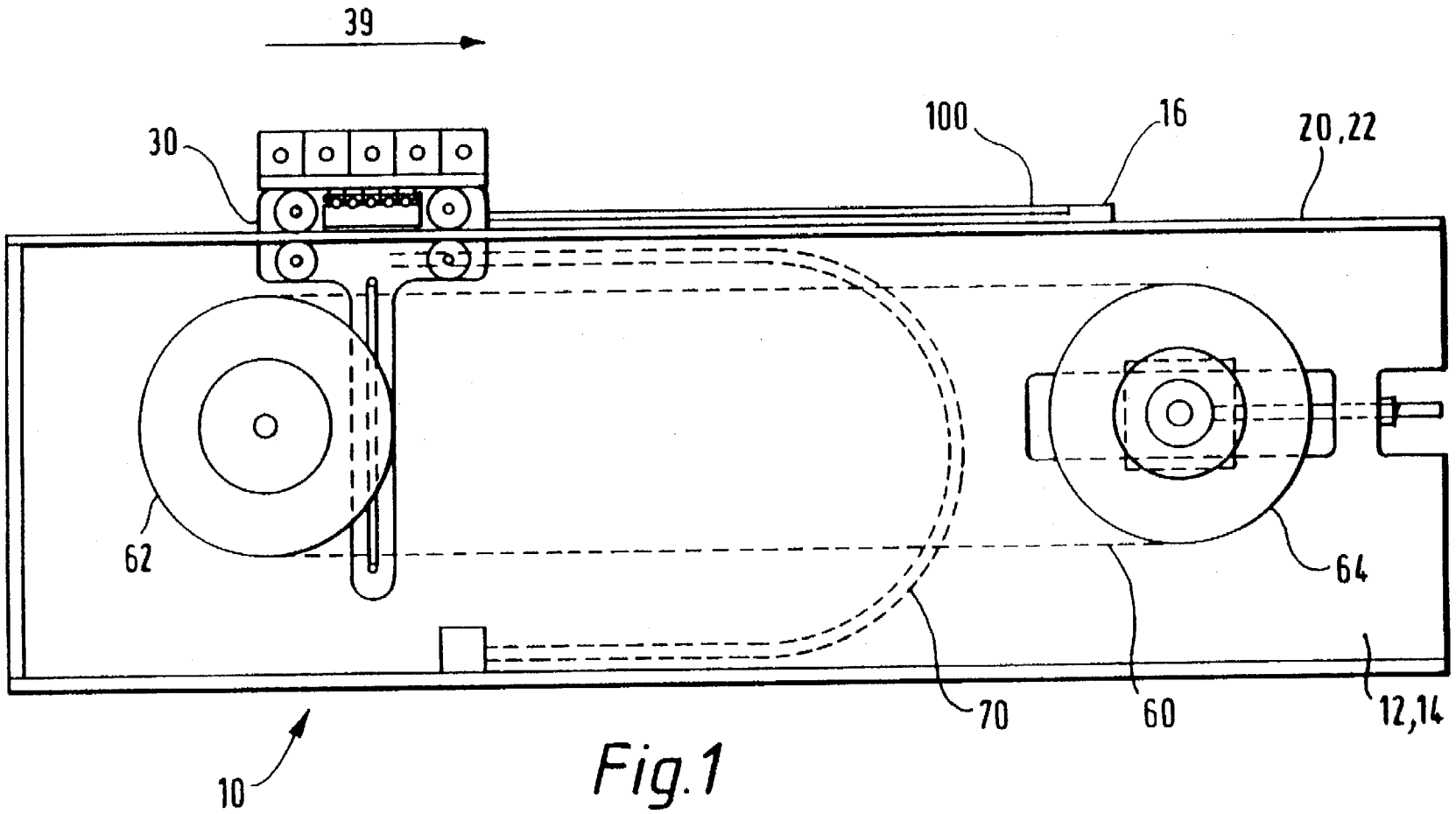
FIG. 1 is a side elevation of one embodiment of processing apparatus in accordance with the present invention with a side wall removed for clarity.

In accordance with the present invention, spray bars may have four main distinct uses in processing a photographic sheet. By the term "spray bar" is meant a bar having a plurality of holes formed along its length through which processing solution or air can be directed.

The first use is the application of a thin layer of solution to the surface of a photographic sheet by pumping solution through the spray bar and effecting relative movement between the spray bar and the sheet being processed. Sufficient pressure must be used to obtain good jets of solution from each hole in the spray bar otherwise adjacent jets will tend to coalesce to form rivulets which are unsuitable for the purpose. If sufficient pressure is used to overcome the formation of rivulets and the holes are too large, then the solution flow will be too high for thin layers of solution to be applied. Pressures above 20.67 kPa (3 psi) are preferred. The diameter of the holes should be typically around 100 μm. A different spray bar is used for each processing solution so that there is no contamination of the solutions.

A second use of the spray bar is to move the solution on the surface of a horizontal sheet by pumping air at low pressure through one spray bar to create air jets directed at the sheet, whilst moving the spray bar over the surface of the sheet. This causes a wave of liquid to be moved along the sheet, and the wave can be returned to its starting position by turning off the air, moving the spray bar beyond the wave, and reversing the movement. This can be repeated as often as required. A suitable range of angles between the jet and the surface of the sheet is 30° to 90° . However, 90° is preferred.

In addition to agitating the solution and ensuring that local areas of high demand do not locally exhaust the processing solution, this process can be used to improve mixing of two liquids which have been separately applied but which must be mixed to act properly, for example, hydrogen peroxide and p-phenylenediamine developer in redox amplification processing chemistry.

A further implementation of this wave is to ensure that the first spray did not leave any dry pin holes on the surface of the sheet if adjacent jets are poorly directed or some of the holes are blocked.

A third use of the spray bar is to remove all solution from the surface of a horizontal surface. In this application, the spray bar is used as an air knife which is constructed to use a comparatively small amount of air, under 6l/min at a pressure of 34.35 kPa (5 psi). At this flow rate and pressure, the air knife is almost silent. This particular use is similar to that which holds a bead of solution in one place on a rotating drum which is described later. A suitable angle between the jet and the sheet surface for this application is between 30° and 90° with a preferred angle of 45°.

A fourth use of the spray bar is to aid drying. If the air knife is passed over the sheet several times after the last of the final solution has been removed, the sheet dries much quicker. This is particularly the case if the support on which the sheet is processed is heated. The range of angles for this application is between 20° and 90°, preferably 80°.

In FIG. 1, a processor 10 is shown which utilizes fine spray bars to process photographic products. The processor 10 comprises a pair of opposed side plates 12, 14 (only one of which is shown for clarity) and a flat platen 16 supported thereby. A photographic sheet 100 is positioned on the platen 16 and is held in place and flat by suction. Naturally, the sheet 100 may be held in place by any other suitable means, for example, by electrostatic attraction or simply by surface tension. The platen 16 may be heated by means not shown.

Two guide rails 20, 22 (only one of which is shown) are also mounted on respective ones of the tops of the side plates 12, 14. The guide rails 20, 22 carry a carriage 30 on which sprays bars 40, 42, 44, 46, 48 and their associated valves 50, 52, 54, 56, 58 are mounted. The carriage 30 is guided on rails 20, 22 by means of rollers 32, 34, 36, 38 (as shown in FIG. 2).

The carriage 30 is moved on the rails 20, 22 by means of a belt 60 connected to a pulley 62 and idler/tensioner pulley 64. Drive means (not shown) is provided to drive the belt 60 under the control of control means (also not shown).

Processing solutions are supplied to the moving carriage 30, from respective reservoirs (not shown), by means of a plurality of flexible pipes 70 which are allowed to roll into a loop to reduce bending resistance. An air supply (not shown) is also supplied to the carriage 30.

Figure 2:
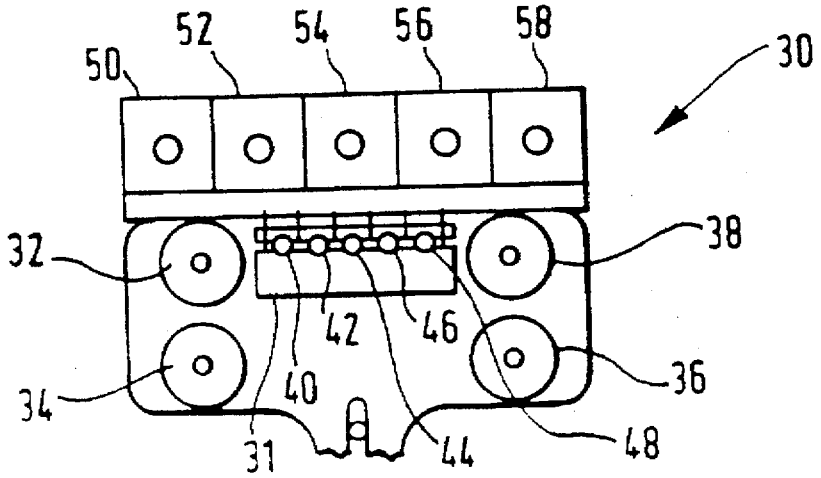
FIG. 2 is an enlarged view of the carriage used in the apparatus of FIG. 1.

In FIG. 2, the carriage 30 is shown in more detail. The carriage 30 comprises a bracket 31 on which the spray bars 40, 42, 44, 46, 48 and their associated valves 50, 52, 54, 56, 58 are mounted. The spray bars 40, 42, 44, 46, 48 are arranged so that they lie across the width of the platen 12 and hence over the photographic sheet 100. One spray bar is utilized for each processing solution and one spray bar is used for the air supply. The supplies of processing solutions and air are controlled by the respective valves 50, 52, 54, 56, 58.

In operation, the photographic sheet 100 is held flat and as the carriage 30 passes over it, in the direction indicated by arrow 39, FIG. 1, one processing solution is applied at a time. The application and time are controlled by a control unit (not shown). The control unit may comprise a computer.

Figure 3:
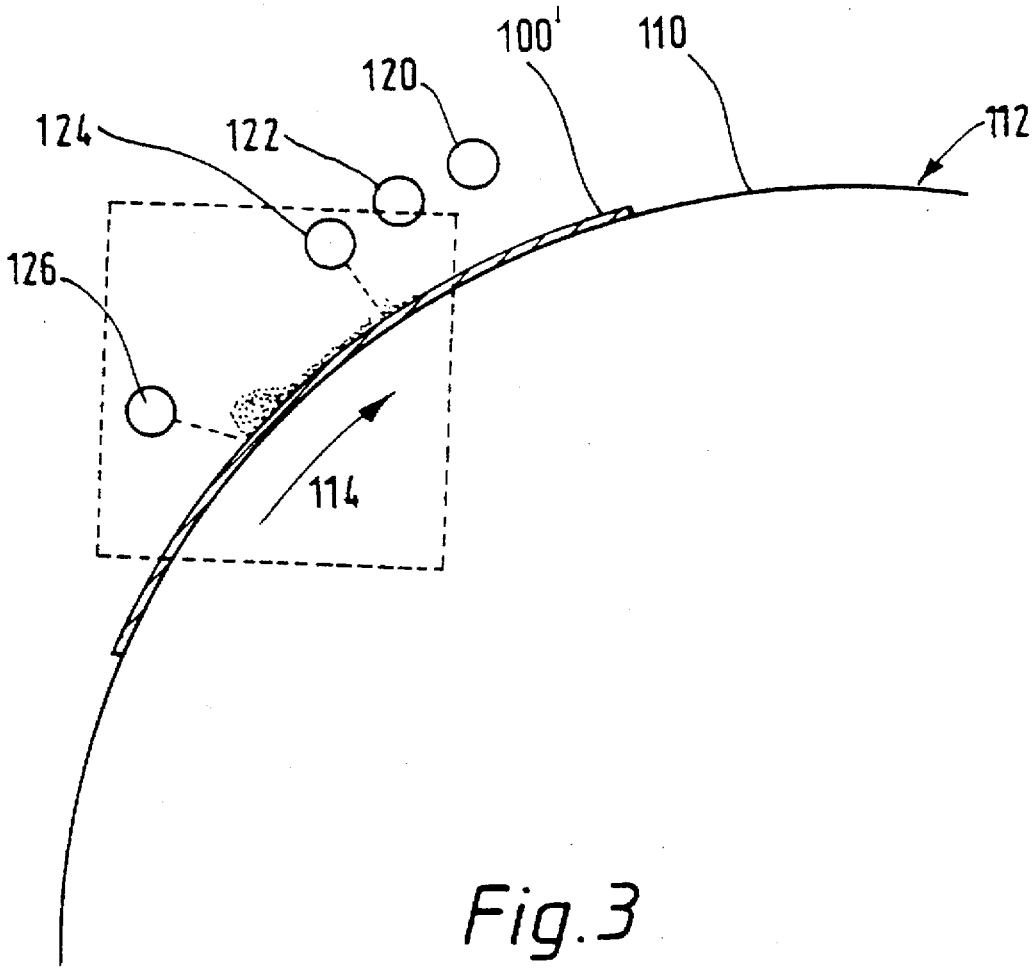
FIG. 3 illustrates apparatus in accordance with a second embodiment of the present invention.

In FIG. 3, a photographic sheet 100' is shown held on a portion 110 of the surface a rotating drum 112. Spray bars 120, 122, 124 are positioned above the surface of the rotating drum 112 for applying processing solutions to the surface of the photographic sheet 100' to be treated. A further spray bar 126, spaced from the other bars 120, 122, 124, is connected to an air supply (not shown) and acts as an air knife.

In this embodiment, the spray bars 120, 122, 124 are fixed and the rotating drum 112 provides the relative movement necessary to apply the processing solutions to the photographic sheet 100', the drum rotating in the direction indicated by arrow 114.

Figure 4:
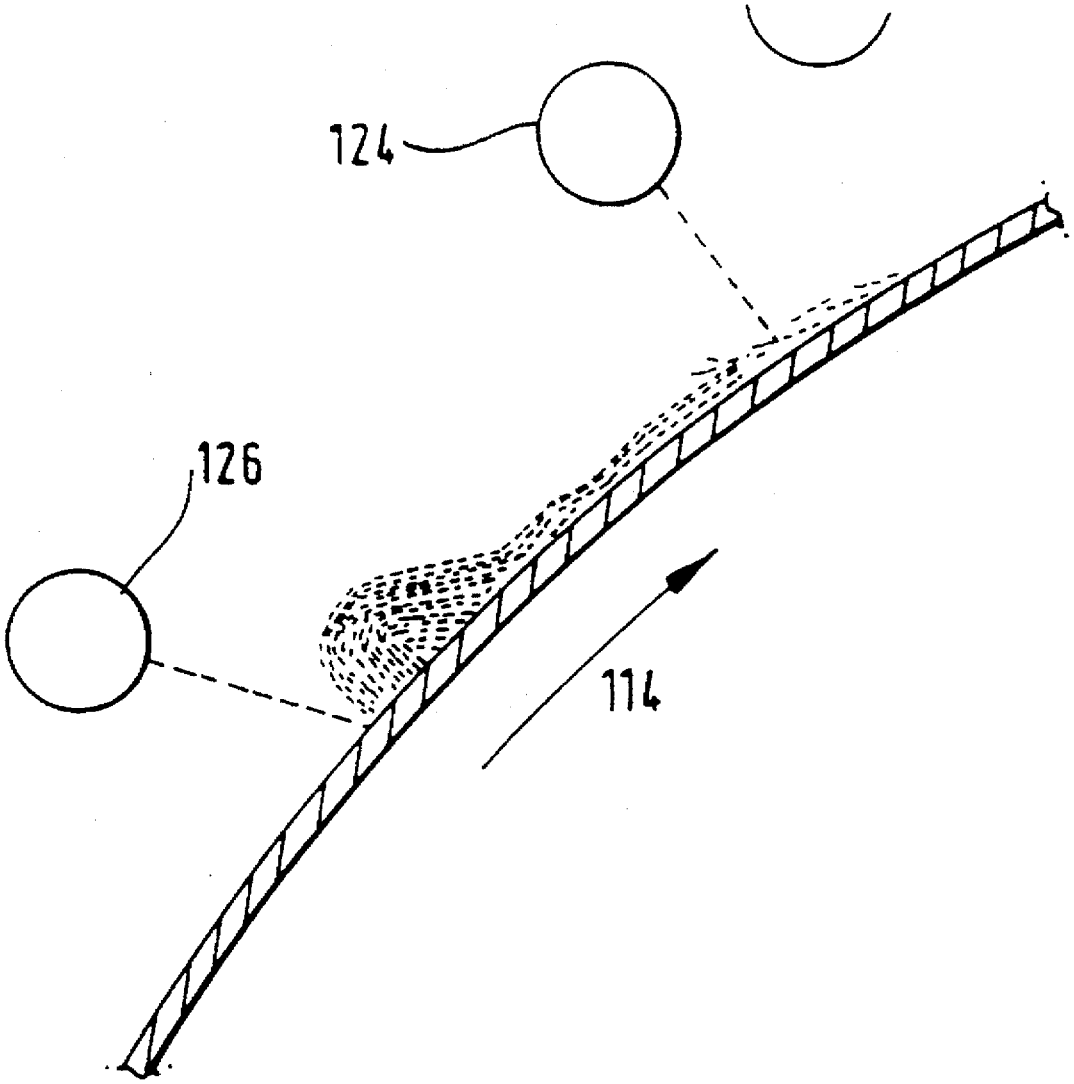
FIG. 4 is an enlarged view of the surface of the material being processed using apparatus shown in FIG. 3.

As is shown more clearly in FIG. 4, processing solution from one of the spray bars 124 is sprayed on to the photographic sheet 100'. Due to the positioning of the spray bar 124, processing solution runs down over the surface of the sheet, against the direction of rotation (arrow 114) of the rotating drum 112 under the influence of gravity. The air knife 126 prevents the solution running further down against the direction indicated by arrow 114. The photographic sheet 100' can be wetted many more times before the processing solution is removed using the air knife 126. The next processing solution can be applied in a similar manner.

Advantageously, a processor constructed in with spray bars in accordance with the present invention is capable of processing sheet materials in a very uniform way as fresh processing chemistry is used for each sheet of material.

Furthermore, the processor is compact and can be retained in a cartridge which contains all the necessary processing chemistry and capable of collecting all waste products within a suitable container.

Processing using spray bars can be very fast. The support on which the sheet is mounted for processing can be heated which effectively raises the temperature of the process without raising the temperature of the bulk processing solutions above ambient conditions.

The processor as described in FIGS. 1 and 2 has only a few moving parts and is relatively inexpensive to manufacture.

The pressure required to pump the processing solutions can be provided by a conventional propellant gas. The solutions and/or gas could be supplied in conventional aerosol cans which could be operated by a suitable cam arrangement activated by the movement of the spray bar relative to the sheet of material being processed. A conventional propellant may have too high a vapor pressure to be used directly and a pressure reduction arrangement would need to be employed.

The fine holes in the spray bar may be subject to blocking given the type of solutions being used. Filtered solutions should be used and the bars parked on a pad to prevent them drying out. Furthermore, the use of unsaturated solutions is advantageous.

The effect of blocked holes can be reduced by using several passes rather than a single pass to put down a layer of processing solution, especially if the bar is moved longitudinally between passes.

Another way of overcoming the effect of blocked holes is to supply processing solutions from opposite ends of the bar for alternate passes. This has the effect of slightly altering the angle of the jets as they emerge from the bar and changing the track position on the sheet being processed.

In accordance with another aspect of the present invention, experiments were carried out to determine the efficacy of solution removal using air knives. An air knife was made from tubing having an external diameter of 4 mm and a series of holes of diameter 80 μm were drilled in the tubing at a pitch of 0.5 mm.

EXAMPLE 1

The air knife was positioned in a carriage 30 (FIG. 1) at a height of 6 mm above a sheet of EKTACOLOR photographic paper (EKTACOLOR is a registered trademark of Eastman Kodak Company) having a width of 165 mm (6.5 in) and a length of 465 mm (18.3 in). The paper was positioned on a brass platen which was heated by pumping water therethrough.

Liquids were added to the paper surface and the effectiveness of the removal of those liquids was determined. The effectiveness being measured by touch, that is, when the paper sheet was no longer sticky. The results obtained are shown in Table 1.

TABLE 1

| Temperature of platen, °C. | Number of passes of air knife | Drying time, s |
|---|---|---|
| 45 | 1 | 50 |
| | 3 | 35 |
| 35 | 1 | 95 |
| | 4 | 40 |

EXAMPLE 2

The effects of rate and pressure on liquid removal and drying time were investigated. In this example, the air jets were directed vertically downwards onto sheets of unprocessed EKTACOLOR paper which had been soaked in tap water to simulate the material having been processed. By "vertically downwards" is meant at an angle of 0°, that is, top dead center, with respect to the plane orthogonal to the surface of the material. Air was supplied to the spray bar at a pressure of 68.7 kPa (10 psi). The results obtained are shown in Table 2.

TABLE 2

| carriage speed, $cms^{-1}$ | spray time, s | no. of air knives | no. of passes | drying time, s |
|---|---|---|---|---|
| 3 | 120 | 1 | 3 | 60 |
| 5 | 80 | 1 | 3 | 40 |
| 7 | 56 | 1 | 3 | 30 |
| 9 | 32 | 1 | 4 | 40 |
| 14 | 28 | 1 | 5 | 45 |
| 20 | 17 | 1 | 8 | 70 |
| 28 | 14 | 2 | 8 | 80 |
| 38 | 10 | 3 | 12 | 90 |
| 50 | 7 | 3 | 13 | 120 |

EXAMPLE 3

The experiment described in Example 2 was repeated using an air pressure of 34.35 kPa (5 psi) and the results obtained are shown in Table 3.

TABLE 3

| carriage speed, $cms^{-1}$ | spray time, s | no. of air knives | no. of passes | drying time, s |
|---|---|---|---|---|
| 3 | 120 | 1 | 2 | 40 |
| 5 | 80 | 1 | 3 | 40 |
| 7 | 56 | 1 | 4 | 50 |
| 9 | 32 | 1 | 5 | 60 |
| 14 | 28 | 1 | 8 | 80 |
| 20 | 17 | 1 | 10 | 100 |
| 28 | 14 | 1 | 11 | 105 |
| 38 | 10 | 5+ | 12 | 120 |
| 50 | 7 | 5+ | 15 | 180 |

EXAMPLE 4

The angle of the jets was altered to 20° from perpendicular (that is, 70° from sheet surface) and the number of passes required for complete removal of bulk liquid was noted. Air was supplied at pressures of 34.35 kPa (5 psi) and 68.7 kPa (10 psi). The results were as shown in Table 4.

TABLE 4

| Pressure, psi | Carriage speed | No. of air knives |
|---|---|---|
| 5 | 38 | 2 |
| | 14 | 1 |
| 10 | 38 | 1 |
| | 50 | ~1 |

EXAMPLE 5

The angle of the jets was change to 45°. The spacing between the spray bar and the paper was set at 3 mm and 6 mm. The results shown in Table 5 were obtained.

TABLE 5

| Spacing, mm | carriage speed, $cm^{-1}$ | spray time, s | no. of passes | drying time, s |
|---|---|---|---|---|
| 6 | 3 | 120 | 2 | 25 |
| | 5 | 80 | 2 | 25 |
| | 7 | 56 | 4 | 40 |
| | 9 | 32 | 5 | 50 |
| | 14 | 28 | 6 | 55 |
| 3 | 3 | 120 | 2 | 30 |
| | 5 | 80 | 3 | 35 |
| | 7 | 56 | 4 | 40 |
| | 9 | 32 | 4 | 45 |
| | 14 | 28 | 6 | 55 |

EXAMPLE 6

The spray bar was replaced with a wide diameter tube and a restriction was placed on it to bring the pressure down to 68.7 kPa (10 psi). It was assumed that the same air flow was passing through the tube as was passing through the spray bar, driven by a pressure drop of the order of 137.4 kPa (20 psi). This pressure drop was not accurately determined. The air from the tube was passed into an inverted container full of water which was positioned in a tray of water. The container had a volume of 50 l . The air flow took 40 s to displace 50 l of water, that is, a rate of displacement of 75 l/min (2.6 $ft^3$/min).

EXAMPLE 7

Example 6 was repeated using an air pressure of 34.35 kPa (5 psi). It took 60 s to displace 50 l of water giving a rate of displacement of 50 l/min (1.8 $ft^3$/min).

In accordance with a further aspect of the present invention, it has been found that jets of air from a spray bar which is directed at a surface of a piece of photographic paper has a beneficial effect on the drying time of the paper. It is believed that the jets stir the boundary layer rather than dry the liquid with more air.

It appears that the most important factor is the pressure of the air within the spray bar. In order to keep the volume of air down (and hence the mechanical work done), the holes in the spray bar must be very small, that is, the diameter of the holes being typically less than 100 μm. Using very small holes also reduces the mass of air and also the tendency of the air to disturb the surface of an unhardened set gelatin layer, for example, although the boundary layer is still being disturbed.

EXAMPLE 8

An experiment was set up to determine the differences in rates of cooling an aluminum block when different air sources were used. The time was measured to cool the block from 50° C. to 40° C. and the results obtained are given below:

| Source | Time, s |
|---|---|
| Air line with 80 μm spray bar at 15 psi | 2.47 |
| Small compressor with 80 μm bar at 15 psi | 4.2 |
| Small compressor with 330 μm bar at 15 psi | 13.7 |
| High volume low pressure pump supplied by ACI* | 5.55 |
| Air knife supplied by ACI* | 4.25 |
| Conventional cooling fan | 11.33 |

*ACI are Air Control Installations Limited

These results were obtained under changing conditions and merely serve as a qualitative guide.

The air was on continuously to get the above results, but it is envisaged that a system of separate drying bars spaced at intervals along a drying track may produce similar results. In this case, the air jets would only intermittently affect any part of a web passing therethrough with a steady background of standard drying conditions.

A system was set up to simulate the effect of a web passing under a series of spray bars on a drying track. A single spray bar was connected to an air supply at 6.87 kPa (1 psi) and pulsed with air at 68.7 kPa (10 psi) for 0.2 s at predetermined intervals to simulate a web passing under the bars along the drying track. It was found that the more pulses used the more effective the drying, and that it was possible to more than double the rate of drying with a realistic markspace ratio.

It appears that the pressure of the air in the spray bar is the major factor in determining the drying rate, the rate being three times faster at 34.35 kPa (5 psi) than at 6.87 kPa (1 psi) but only four times faster at 103 kPa (15 psi). It appears that the rate of heat transfer rises rapidly with pressure, reaching an asymptote at something over 103 kPa (15 psi). A working pressure of 34.35 kPa (5 psi) is preferred.

PARTS LIST

10 . . . processor
12,14 . . . side plates
16 . . . flat platen
20,22 . . . guide rails
30 . . . carriage
31 . . . bracket
32,34,36,38 . . . rollers
39 . . . arrow
40,42,44,46,48 . . . bars
50,52,54,56,58 . . . valves
60 . . . belt
62 . . . pulley
64 . . . idler/tensioner pulley
70 . . . flexible pipes
100,100' . . . photographic sheet
110 . . . portion
112 . . . rotating drum
114 . . . arrow
120,122,124,126 . . . spray bars

What is claimed is:

1. Processing apparatus for processing photographic material, the apparatus including:

a support surface for supporting the photographic material during processing thereof; and applicator means for applying processing fluid to the material supported by the support surface;

characterized in that the applicator means comprises at least one bar having a plurality of uni-jets equally spaced along its length, the bar is positioned so that each uni-jet is directed to impinge on the material to effect processing thereof, each spray bar comprises a tube having a series of very fine holes formed therein.

2. Apparatus according to claim 1, wherein the support surface comprises a substantially horizontal flat platen.

3. Apparatus according to claim 2, wherein the material is held on the platen by suction.

4. Apparatus according to claim 1, further including transport means for moving each spray bar over the material to be processed.

5. Apparatus according to claim 4, wherein the transport means comprises a carriage on which each spray bar is mounted, the carriage being guided on rails by means of a driven belt arrangement.

6. Apparatus according to claim 1, wherein a plurality of spray bars are provided, each spray bar being fluidly connected to an associated reservoir via a valve and a flexible pipe.

7. Apparatus according to claim 1, wherein the support surface comprises the cylindrical surface of a rotating drum.

8. Apparatus according to claim 7, wherein a bead of processing solution is established on the material using a further spray bar as an air knife.

9. Apparatus according to claim 1, wherein each hole has a diameter of less than 100 μm.

10. A method of processing photographic material comprising the steps of:

a) supporting the material on a support surface;

b) applying at least one processing solution to the supported material using at least one first bar having a plurality of uni-jets formed therein;

c) removing the processing solution from the supported surface using a second bar connected to an air supply, the second bar acting as an air knife; and d) drying the material using the second bar.

11. A method according to claim 10, wherein the material is supported on a substantially flat platen, step b) being achieved by relative movement between each first bar and the supported material, each first bar applying a predetermined processing solution to the supported material.

12. A method according to claim 11, wherein at least two processing solutions are applied to the surface of the supported material, the processing solutions being mixed thereon using the second bar.

13. A method according to claim 10, wherein the material is supported on a rotating cylindrical surface, step b) being achieved by establishing a bead of processing solution on the surface of the material using a third bar connected to an air supply.

14. Processing apparatus for processing photographic material, the apparatus including:

a support surface for supporting the photographic material during processing thereof; and applicator means for applying processing fluid to the material supported by the support surface;

characterized in that the applicator means comprises at least one bar having a plurality of uni-jets equally spaced along its length, the bar is positioned so that each uni-jet is directed to impinge on the material to effect processing thereof, transport means are provided for moving each spray bar over the material to be processed.

15. Processing apparatus for processing photographic material, the apparatus including:

a support surface for supporting the photographic material during processing thereof; and applicator means for applying processing fluid to the material supported by the support surface;

characterized in that the applicator means comprises a plurality of bars each having a plurality of uni-jets equally spaced along its length, the bar is positioned so that each uni-jet is directed to impinge on the material to effect processing thereof and being fluidly connected to an associated reservoir via a valve and a flexible pipe.

16. Processing apparatus for processing photographic material, the apparatus including:

a support surface for supporting the photographic material during processing thereof; and applicator means for applying processing fluid to the material supported by the support surface;

characterized in that the applicator means comprises at least one bar having a plurality of uni-jets equally spaced along its length, the bar is positioned so that each uni-jet is directed to impinge on the material to effect processing thereof, the support surface comprises the cylindrical surface of a rotating drum.

* * * * *